US005381164A

United States Patent [19]

Ono

[11] Patent Number: 5,381,164

[45] Date of Patent: Jan. 10, 1995

[54] RECORDING METHOD AND APPARATUS FOR PREHEATING A THERMALLY ACTIVATED PRINTING READ

[75] Inventor: Takeshi Ono, Yokohama, Japan

[73] Assignee: Canon Kabushiki Kaisha, Tokyo, Japan

[21] Appl. No.: 933,662

[22] Filed: Aug. 24, 1992

Related U.S. Application Data

[62] Division of Ser. No. 374,658, Jun. 30, 1989, Pat. No. 5,191,357.

[30] Foreign Application Priority Data

| | | | |
|---|---|---|---|
| Jul. 1, 1988 | [JP] | Japan | 63-162605 |
| Jul. 1, 1988 | [JP] | Japan | 63-162606 |
| Jun. 28, 1989 | [JP] | Japan | 1-163852 |

[51] Int. Cl.[6] ..... B41J 2/38; B41J 2/35; B41J 2/32

[52] U.S. Cl. ..... 346/76 PH

[58] Field of Search ..... 346/1.1, 76 PH; 360/140 PD; 358/296

[56] References Cited

U.S. PATENT DOCUMENTS

| | | | |
|---|---|---|---|
| 4,449,137 | 5/1984 | Inui et al. | 346/76 PH |
| 4,952,942 | 8/1990 | Kanome et al. | 346/1.1 |
| 5,191,357 | 3/1993 | Ono | 346/76 PH |

FOREIGN PATENT DOCUMENTS

| | | |
|---|---|---|
| 54-13345 | 1/1979 | Japan . |
| 57-27772 | 2/1982 | Japan . |
| 59-76275 | 5/1984 | Japan . |
| 63-134259 | 6/1988 | Japan . |

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

A recording apparatus for performing recording on a recording medium includes a plurality of recording elements, and a control unit for selectively providing energy having a level lower than an actual recording level to adjacent ones of the plurality of recording elements and to successively apply the energy to the see recording element when the energy is applied to the recording elements within waiting time from an end of a recording operation to a start of the next recording operation.

26 Claims, 7 Drawing Sheets

RECORDING METHOD AND APPARATUS FOR PREHEATING A THERMALLY ACTIVATED PRINTING READ

This application is a division of application Ser. No. 07/374,658 filed Jun. 30, 1989, U.S. Pat. No. 5,191,357.

BACKGROUND OF THE INVENTION

1. Field of the Invention

The present invention relates to a method and an apparatus for performing recording by heating and driving recording elements.

Recording apparatuses benefitting from this invention can be used in a facsimile machine, a typewriter, a copying machine, and a printer. Recording systems for performing recording upon heating of heating elements which can employ the present invention include so-called ink-jet, thermal transfer, thermal, and electro-thermosensitive recording systems.

2. Related Background Art

Related arts will be described by exemplifying a thermal printer as a recording apparatus.

When a conventional thermal printer is installed at a low ambient temperature or a time interval to the next recording cycle is prolonged, a thermal head is undesirably cooled. Even if the thermal head is energized within the same period of time as in the previous recording cycle, the density of a recorded image may be decreased. In order to eliminate this drawback, the thermal head is pre-heated in a thermal printer, facsimile machine or the like prior to a recording operation. Pre-heating prevents electrodes of heating resistors of the thermal head from being corroded by moisture in air or of recording paper or by ions in a thermal agent when a voltage is applied to the thermal head and the heating elements are not energized (e.g., during transmission in a facsimile machine). In the pre-heat operation, predetermined data output to the thermal head is constant. The temperature of the heating resistors of the head must be kept as high as possible, while not causing color development when thermal recording paper is used.

"All black" data are transferred to the thermal head during pre-heat, and strobe signals are intermittently output to drive the heating elements. In general, when black data are respectively supplied to adjacent dots, heat storage is increased and color development tends to occur. In addition, when the same heating resistor is continuously energized, heat storage is increased to tend to cause color development. For example, color development of the recording paper tends to occur even within a short period of energization time.

Generally, pre-heating is performed when a temperature value less than a predetermined value is sensed by a temperature sensor for detecting the temperature of a thermal head. In order to prevent color development of thermal paper serving as a recording medium during pre-heat, the number of strobe signals or the number of energization cycles is reduced, or the temperature value for starting pre-heat must be reduced. Since the temperature of the thermal head cannot be sufficiently increased during pre-heat, all of the benefits of pre-heat cannot be realized. In another thermal printer wherein .its heating resistors are divided into N blocks and heating is performed in each unit of blocks, pre-heat time may tend to be prolonged.

SUMMARY OF THE INVENTION

It is an object of the present invention to provide a method and an apparatus for performing recording which can improve recording quality.

It is another object of the present invention to provide a method and an apparatus for performing recording which can increase a recording speed.

It is still another object of the present invention to provide a method and an apparatus for pre-heating a thermal head to keep its temperature substantially constant and keep a color development temperature of recording paper almost even to improve recording quality when recording by the thermal head is not performed.

It is still another object of the present invention to provide, in consideration of the aforementioned conventional examples, a method and an apparatus for performing effective pre-heat wherein data output to the head is adjusted during pre-heat to minimize heat storage of the head and to prevent color development of the thermal recording paper even if a substrate temperature of the thermal head becomes higher than that in a conventional apparatus.

It is still another object of the present invention to provide, in consideration of the aforementioned conventional examples, a method and an apparatus for performing recording wherein all blocks are simultaneously energized during pre-heat to shorten the pre-heat time by reducing the number of black data of pre-heat recording data to be 1/(block count N) or less.

DETAILED DESCRIPTION OF THE PREFERRED EMBODIMENTS

Preferred embodiments of the present invention will be described with reference to the accompanying drawings.

(Description of Thermal Printer (FIG. 1))

Figure 1:
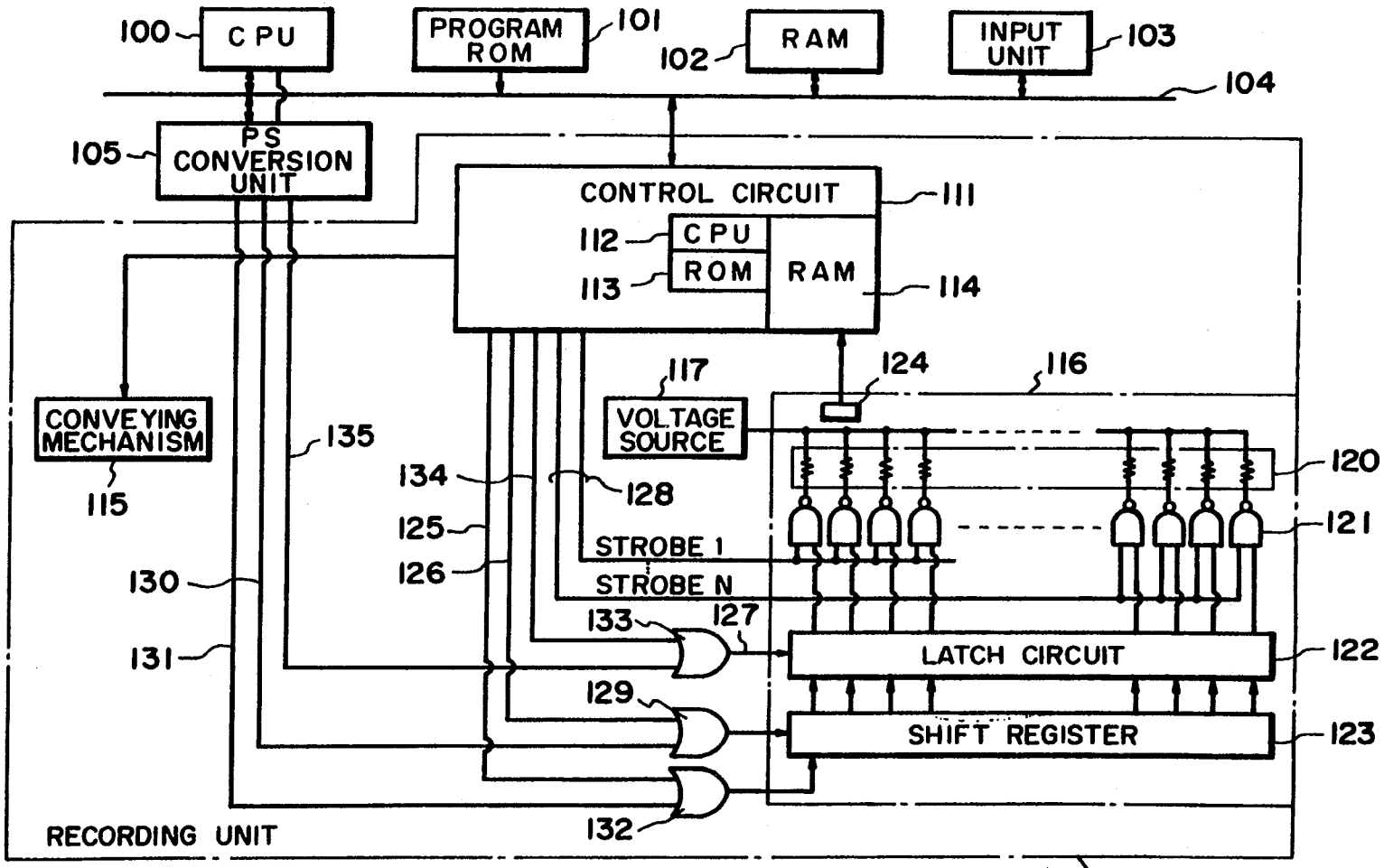
FIG. 1 is a schematic block diagram showing an arrangement of a the thermal printer according to an embodiment of the present invention.

FIG. 1 is a schematic block diagram showing an arrangement of a thermal printer according to an embodiment of the present invention.

The thermal printer includes a CPU 100 such as a microprocessor for controlling the thermal printer, a program ROM 101 for storing control programs for the CPU 100 and various data, a RAM 102 used as a work area of the CPU 100, an input unit 103 for receiving recording data, control data and the like from host equipment, a system bus 104 including data, control signals and the like from the CPU 100, and a PS conversion unit 105 for receiving parallel data and outputting a serial signal.

A recording unit 110 conveys recording paper such as thermal paper and causes a thermal head 116 to perform recording on the recording paper. The arrangement of the recording unit 110 will be described below. A control circuit 111 controls the recording unit 110 and comprises a CPU 112 such as a microprocessor, a ROM 113 for storing the control program (flow chart in FIG. 2) for the CPU 112 and various data, and a RAM 114 used as a work area of the CPU 112. A conveying mechanism 115 includes a conveying motor for conveying recording paper and rollers driven by the conveying motor and conveys the recording paper.

The thermal head 116 includes, e.g., 2048 heating resistors 120 arranged in line. A voltage source 117 supplies a voltage to the heating resistors 120 of the thermal head 116. The heating resistors 120 are divided into, e.g., foyer blocks, and are driven to generate heat in units of blocks. Drivers 121 respectively drive the heating resistors 120. A shift register 123 shifts and stores one-line recording data for the thermal head 116. A latch circuit 122 latches and stores data of the shift register 123 in response to a latch signal 127.

A temperature sensor 124 detects a temperature of the thermal head 116. A shift clock 125 is output from the control circuit 111, and a shift clock 131 is output from the PS conversion unit 105. These clock signals are input to an OR gate or OR circuit 132 and an OR output from the OR gate 132 is input to the shift register 123. Strobe signals 128 are supplied from the control circuit 111 to the thermal head 116 and are used to drive the heating resistors 120 to generate heat in units of blocks in accordance with data from the latch circuit 122.

Pre-heat serial data 126 is output from the control circuit 111. Recording data 130 is output as serial data to be recorded in practice. These two serial data are input to an OR gate 129, and an OR output from the OR gate 129 is input to the shift register 123. A latch signal 134 is output from the control circuit 111, and a latch signal 135 is output from the CPU 100. These latch signals are input to an OR gate 133, and an OR output from the OR gate 133 is output to the latch circuit 122.

With the above arrangement, in a normal recording mode, recording information is input from the input unit 103, and the CPU 100 outputs serial recording data to the thermal head 116 through the PS conversion unit 105 on the basis of the input recording information. Upon termination of transfer of one-line serial data, the CPU 100 determines whether the recording unit 110 currently performs recording. If the recording unit 110 does not currently perform recording, the CPU 100 outputs the latch signal 135 to cause the latch circuit 122 to latch one-line recording data. A command for recording commencement is output from the CPU 100 to the control circuit 111.

When the control circuit 111 of the recording unit 110 receives this command for recording commencement, the control circuit 111 refers to a table or the like of the ROM 113 on the basis of temperature information or the like from the temperature sensor 124 and determines energization time (i.e., a pulse width of each strobe signal 128) of the thermal head 116. The strobe signals 128 are sequentially output to the heating resistors 120 in units of blocks, thereby performing recording in units of blocks. When all four blocks (N) are driven, one-line recording is terminated.

One-line recording is terminated the control circuit 111 outputs pre-heat data to the thermal head 116 to heat the thermal head 116 until the next command for recording commencement is output from the CPU 100 to the control circuit 111. In this case, energization of the thermal head 116 is performed in units of blocks in the same manner as in normal recording. The pulse width of the strobe signal 128 is shorter than that in normal recording.

Figure 3:
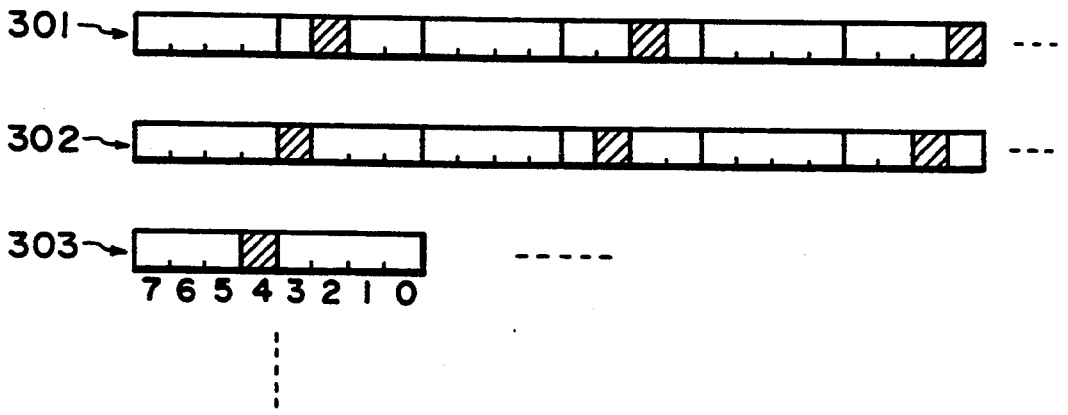
FIG. 3 shows formats of pre-heat data.

FIG. 3 shows data output from the thermal head 116 during pre-heat. More specifically, data 301 is output in the first pre-heat cycle, data 302 is output in the second pre-heat cycle, and data 303 is output in the third pre-heat cycle. Positions of dots energized by these data are defined by hatched portions in FIG. 3. In this embodiment, the position of the dot heated every pre-heat cycle is shifted one by one by data which prevents continuous heating of the same heating resistor and at the same time prevents heating of adjacent resistors (dots). This data is stored in the ROM 113. Therefore, heat storage of the thermal head 116 can be prevented.

(Description of Operation (FIGS. 1 and 2))

Figure 2:
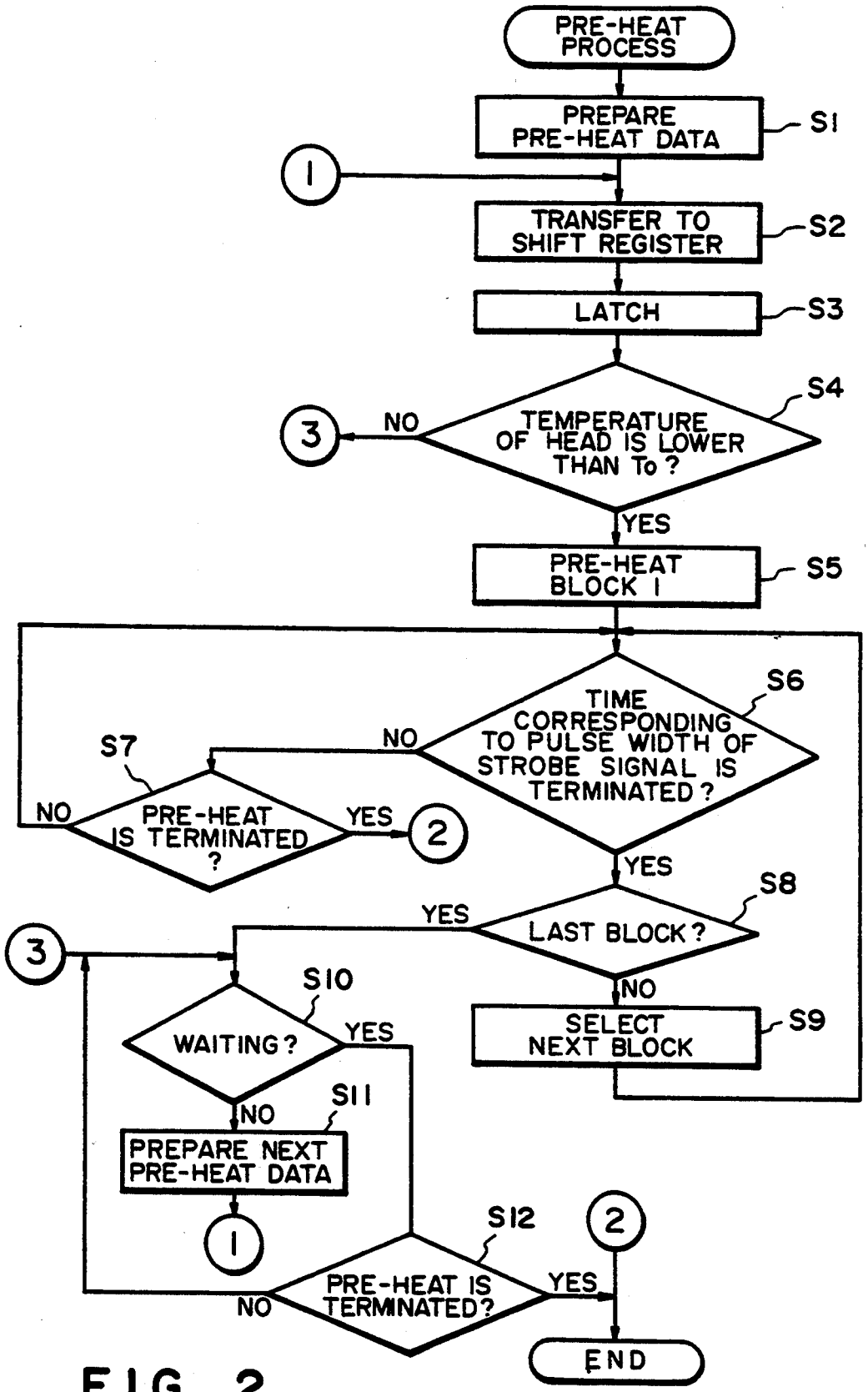
FIG. 2 is a flow chart showing a pre-heat operation by a control circuit in a recording unit of the thermal printer of the embodiment shown in FIG. 1.

FIG. 2 is a flow chart showing pre-heat processing of the control circuit 111 in the recording unit 110 of this embodiment. This processing is started in response to a command for pre-heat commencement from the CPU 100.

When the command for pre-heat commencement is input, one-line pre-heat data is prepared in step S1. In step $2, the one-line serial data 126 is transferred to the thermal head 116 in synchronism with the shift clock 125. This data represents that the number of dots (heating resistors) energized during a one-byte period is one (i.e., both adjacent dots are not energized), as shown in FIG. 3. If the thermal head 116 has a width (about 256 mm) of, e.g., a B4 size and a resolution of 8 pel (dots/mm), one line corresponds to 2048 dots (256 bytes).

When one-line data transfer is terminated in step S2, the flow advances to step S3 to output the latch signal 134 to cause the latch circuit 122 to latch one-line pre-heat data. In step S4, a temperature of the thermal head 116 is detected by the temperature sensor 124 and is compared with a predetermined temperature T0. The temperature T0 is a critical temperature for causing color development of the recording paper by pre-heat when the actual temperature of the thermal head 116 is higher than the predetermined temperature T0.

If the temperature of the thermal head 116 is determined in step S4 to be higher than the predetermined temperature T0, the flow advances to step S10. However, if NO in step S4, a strobe 1 is output in step S5 to pre-heat a block I of the thermal head. The pulse width of the strobe signal at this time is determined not to cause color development of the thermal paper. The CPU 112 determines in step S6 whether time corresponding to the pulse width of the strobe signal is terminated. When the pre-heat time has not passed yet, the CPU 112 determines in step S7 whether a command for pre-heat termination is input from the CPU 100 to the control circuit 111. If YES in step S7, pre-heat processing is completed. Otherwise, the flow returns to step S6 to wait until the time corresponding to the pulse width of the strobe signal has passed.

When the pre-heat time corresponding to the pulse width of the strobe signal is determined to have passed in step S6, the flow advances to step S8 to check if pre-heat processing of the last block (i.e., a fourth block IV) is terminated. If NO in step S8, the flow advances to step S9, and the next pre-heat block is selected, and the corresponding pre-heat strobe is output. The flow then returns to step S6. When the last block N is determined to be pre-heated in step S8, the flow advances to step S10, and waiting time is counted. The flow advances to step S12 during waiting to check whether the command for pre-heat termination is input from the CPU 100 to the control circuit 111.

When waiting is terminated in step S10, the flow advances to step S11, and the next pre-heat data is generated. The flow then returns to step S2, and the above operations are executed. The pre-heat data are obtained by shifting the energization bits one by one within one byte, as indicated by the data 301 to 303 in FIG. 3. Therefore, the same heating resistor is not continuously energized in the successive pre-heat cycles.

Figure 4:
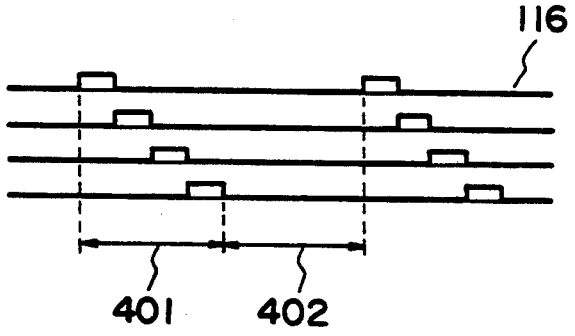
FIG. 4 is a timing chart of a pre-heat operation.

FIG. 4 is a timing chart of waiting time and pre-heat period.

The heating resistors 120 of the thermal head 116 are divided into four blocks. The blocks are sequentially pre-heated. Pre-heat is performed within a period 401 and is suspended during a period 402. In this embodiment, the next pre-heat data is obtained in step S11 after the waiting time. However, generation and transfer of the pre-heat data may be terminated during the waiting time.

In this embodiment, only one bit is set to be "1" during the one-byte period. However, since both the adjacent bits are required to be "0", black data may be applied to 1 to 4 bits within one byte.

In step S6, the pulse width of the strobe signal supplied to the thermal head 116 may be determined on the basis of a value from the temperature sensor 124. Alternatively, the magnitude of pre-heat can be controlled by appropriately selecting the predetermined temperature T0 in step S4, the pre-heat pulse width in step S6, and the waiting time in step S10.

Control of energy applied to the thermal head during the pre-heat is not limited to control of the pulse width of the strobe signal. However, the energy applied to the thermal head may be controlled by, e.g., a voltage or current supplied to the thermal head, or the output frequency of each strobe signal.

In FIG. 3, "1" of the pre-heat data is shifted bit by bit every pre-heat cycle. However, any pre-heat sequence may be employed if both the adjacent bits are set to be "0" and the respective heating resistors are uniformly heated.

According to this embodiment as described above, white data is supplied to any dot adjacent to a dot which receives black data during pre-heat, and the same dot is not continuously pre-heated in the successive cycles. The number of pre-heat strobe pulses is increased, and pre-heat can be effectively performed to increase a thermistor temperature which does not cause color development of the recording paper.

In addition, a ratio of black data to white data within one block is small, and the load on the voltage source can be reduced.

According to this embodiment described above, the data output to the thermal head during pre-heat is adjusted to minimize heat storage of the thermal head. Therefore, the substrate temperature of the thermal head during pre-heat can be higher than that of the conventional thermal head, and at the same time color development of the recording paper can be prevented, thereby efficiently pre-heating the thermal head.

Another embodiment of the present invention will be described with reference to FIGS. 5 and 6.

In this embodiment, energy smaller than recording energy is simultaneously and intermittently supplied to N blocks of heating resistors of a thermal head, thereby heating the heating resistors. During heating by the heating means, data representing that the number of heating resistors to be energized is 1/N or less of the total number of heating resistors and is updated every pre-heat cycle, and is output to the thermal head.

The operations until the end of one-line recording upon heating and driving of all blocks (N) are the same as the previous embodiment, and the description of the previous embodiment applies to this embodiment. Pre-heat control as the main feature of this embodiment will be described below.

Pre-heat of a thermal head 116 is started when a command for pre-heat commencement is supplied from a CPU 100 (a CPU 202 included in a main control unit 200 in an embodiment to be described with reference to FIG. 7) to a control circuit 111. At this time, the control circuit 111 outputs pre-heat data to the thermal head 116 to heat the thermal head 116. In this case, unlike normal recording, all the blocks of the thermal head 116 are simultaneously energized and driven.

Time corresponding to the pulse width of each strobe signal 128 is shorter than normal recording energization time. Since the number of heating resistors to be energized is set to be 1/N of the total number of heating resistors of the thermal head 116, simultaneous energization of all the blocks does not cause the voltage consumption to exceed the capacity of the voltage source 117.

In this embodiment, the number of energized dots represented by hatched portions in FIG. 3 is 1/N or less of the total number of heating resistors.

An operation of this embodiment will be described below. The block diagram representing the arrangement of the thermal printer is the same as that in FIG. 1, and the description made with reference to FIG. 1 applies to this embodiment.

Description of Operation (FIGS. 1 and 5))

Figure 5:
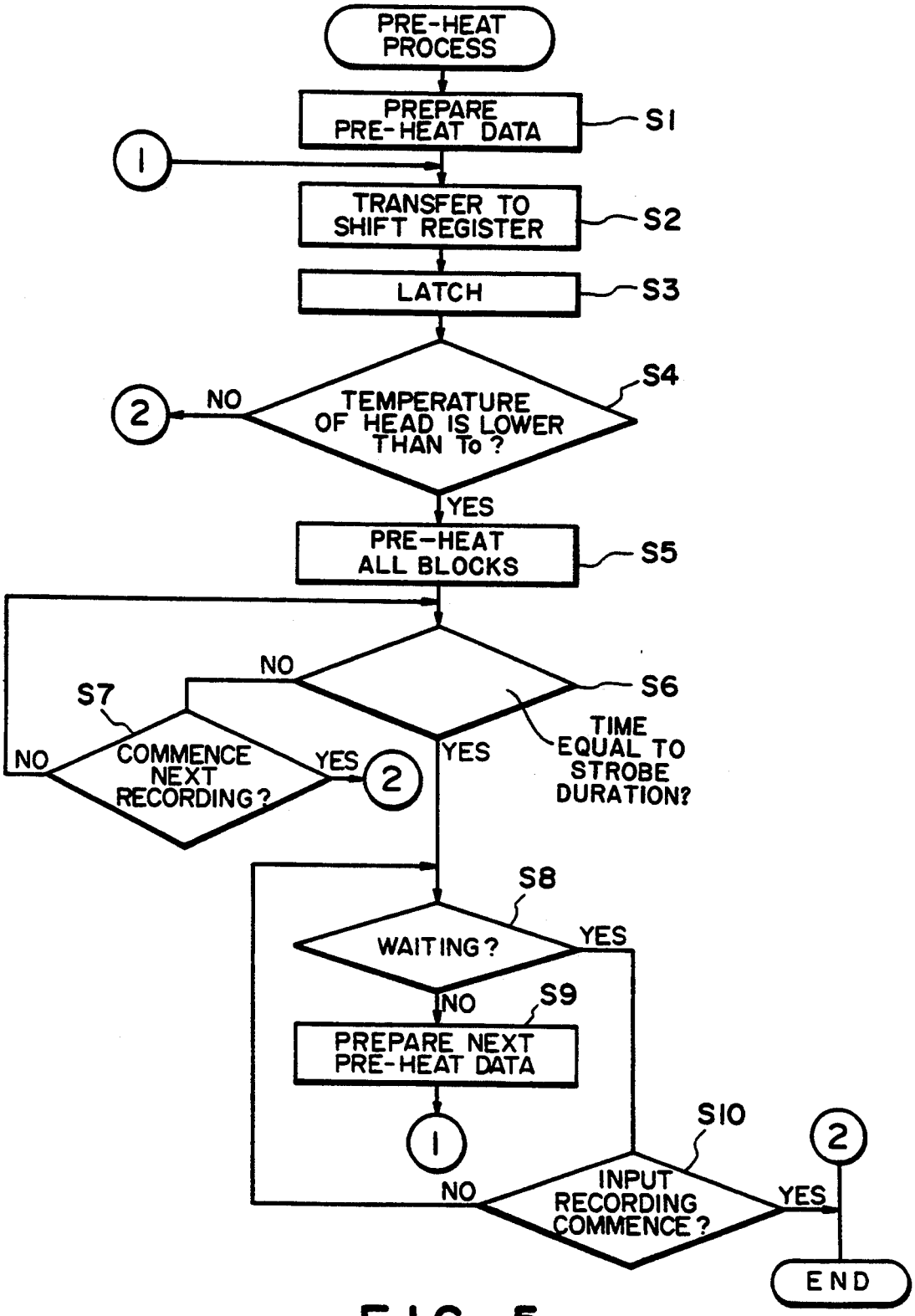
FIG. 5 is a flow chart showing a pre-heat operation by a control circuit of a recording unit of a thermal printer according to another embodiment of the present invention.

FIG. 5 is a flow chart showing pre-heat processing by the control circuit 111 of a recording unit 110 of this embodiment. This processing is started by a command for pre-heat commencement from the CPU 100.

When the control circuit 111 receives the command for pre-heat commencement, one-line pre-heat data is prepared in step S1. This data represents that the number of heating resistors to be energized within one line is set to be 1/N of the total number of heating resistors. One-line pre-heat data is transferred to the thermal head 116 by serial data 126 in synchronism with a shift clock 125. This data represents that a one-bit dot (heating resistor) is energized within the one-byte period, as described with reference to FIG. 3 (at least both adjacent dots are not energized). If the thermal head 116 has a width (about 256 mm) of, e.g., a B4 size and a resolution of eight pel (dots/mm), one line corresponds to 2,048 dots (256 bytes).

When one-line data transfer is terminated in step S2, the flow advances to step S3, and a latch signal 134 is output to cause a latch circuit 122 to latch one-line pre-heat data. A temperature of the thermal head 116 is detected by a temperature sensor 124 and is compared with a predetermined temperature T0. The temperature T0 is a critical temperature above which there is color development of the recording paper during pre-heat because the temperature of the thermal head 116 becomes higher than the predetermined temperature.

If the temperature of the thermal head 116 which is detected by the sensor 124 is higher than the temperature T0 in step S4, the flow advances to step S10. However, if NO in step S4, strobe signals 1 to N are simultaneously output to pre-heat all the blocks of the thermal head 116 in step S5. At this time, the pulse width of each strobe signal 128 is short enough not to cause color development of the recording paper. It is then checked in step, S6 whether time corresponding to the pulse width of the strobe signal has passed. If NO in step S6, the flow advances to step S7 to determine whether a con, hand for pre-heat termination is supplied from the CPU 100 to the control circuit 111. If YES in step S7, pre-heat processing is terminated. However, if NO in step S7, the flow returns to step S6 to wait until the time corresponding to the pulse width of the strobe signal 128 has passed.

When the time corresponding to the pulse width of the strobe signal during the pre-heat is determined to have passed in step S6, the flow advances to step S8, and waiting time is counted. During waiting, the flow advances to step S10 to determine whether the command for pre-heat termination is supplied from the CPU 100 to the control circuit 111.

If YES in step S8, the flow advances to step S9, and the next pre-heat data is prepared. The flow then returns to step S2, and the above operations are repeated. The pre-heat data are obtained by shifting the energization bits one by one within one byte, as indicated by the data 301 to 303 in FIG. 3. Therefore, the same heating resistor is not continuously energized in the successive pre-heat cycles.

Figure 6:
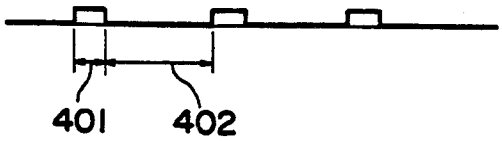
FIG. 6 is a timing chart of a pre-heat operation.

FIG. 6 is a timing chart of waiting time and pre-heat period.

Reference to FIG. 6, the pre-heat data has a pre-heat cycle 401, and waiting time 402 sets the pre-heat period.

In this embodiment, the number of heating resistors to be energized within one line is set to be 1/(block count N) or less of the total number of heating resistors to simultaneously drive all the blocks of the thermal head, thereby shortening the one-line pre-heat time. However, the N blocks may be divided into two portions, and pre-heat may be performed in two steins. In this case, the number of heating elements to be energized may be 1/N or less of the total number of one-line heating resistors in the simultaneously driven blocks.

In step S6, the pulse width of the strobe signal supplied to the thermal head 116 may be determined on the basis of a value from the temperature sensor 124. Alternatively, the magnitude of pre-heat can be controlled by appropriately selecting the predetermined temperature T0 in step S4, the pre-heat pulse width in step S6, and the waiting time in step S10.

Control of energy applied to the thermal head during the pre-heat is not limited to control of the pulse width of the strobe signal. However, the energy applied to the thermal head may be controlled by, e.g., a voltage or current supplied to the thermal head, or the output frequency of each strobe signal.

In FIG. 3, "1" of the pre-heat data is shifted bit by bit every pre-heat cycle. However, any pre-heat sequence may be employed if both the adjacent bits are set to be "0" and the respective heating resistors are uniformly heated.

According to this embodiment as described above, the number of heating resistors to be heated is set to be 1/N (where N is the number of blocks of the thermal head) or less of the total number of heating resistors. All the blocks are simultaneously energized to shorten the pre-heat time.

Since the pre-heat data transferred to the thermal head is prepared by the recording control unit, a pre-heat operation can be performed while other operations such as a transmission operation are performed in a facsimile machine or the like.

According to the above embodiment, since the number of the black data of the pre-heat recording data can be set to be 1/N or less, all the blocks can be simultaneously energized during pre-heat, and the pre-heat time can be shortened.

The pre-heat load of the control unit for actually controlling the recording operation can be reduced.

A facsimile machine which employs the above thermal printer will be described with reference to FIGS. 7 to 9.

(Description of Facsimile Machine (FIGS. 7 and 8))

Figure 7:
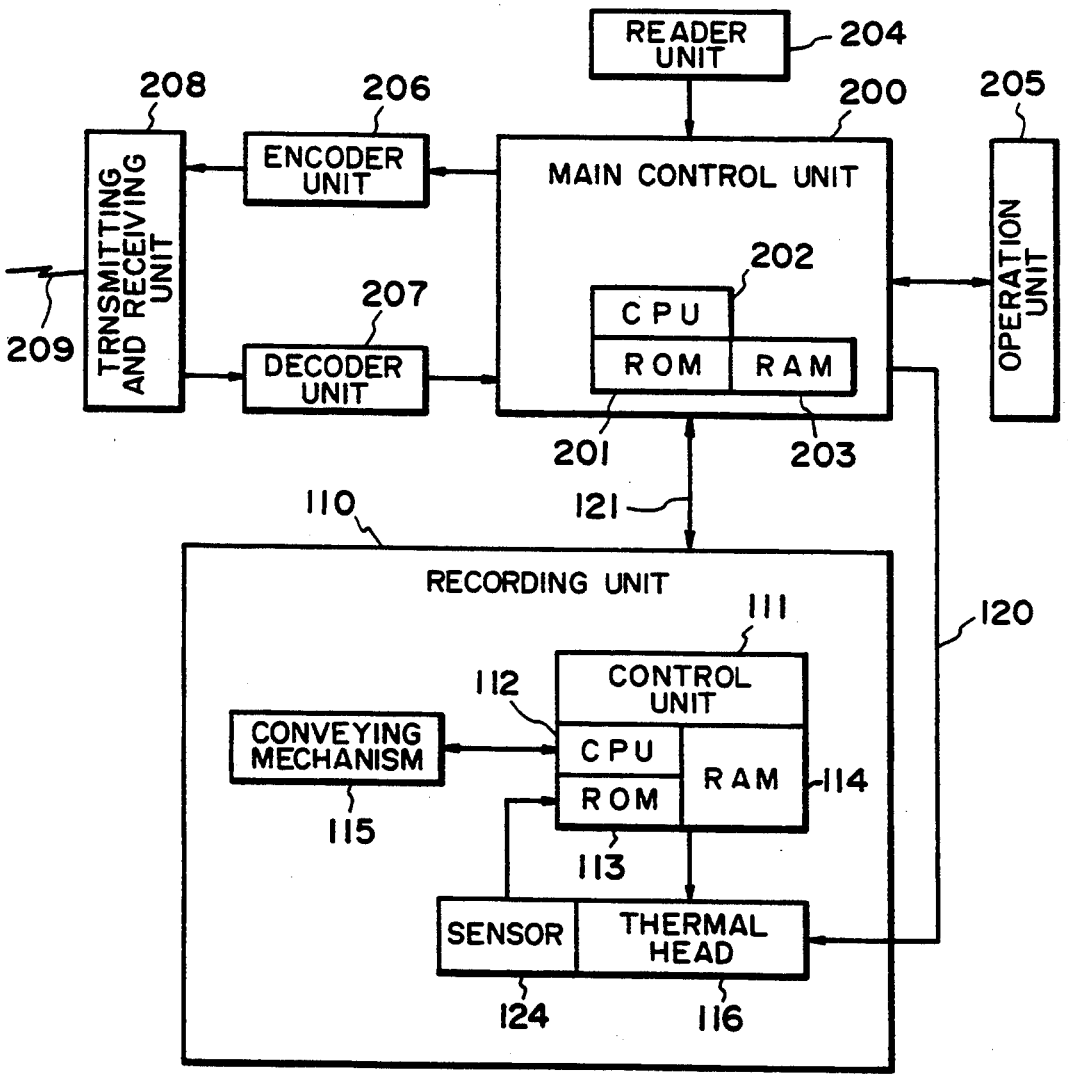
FIG. 7 is a schematic block diagram of a facsimile machine according to still another embodiment of the present invention.
Figure 8:
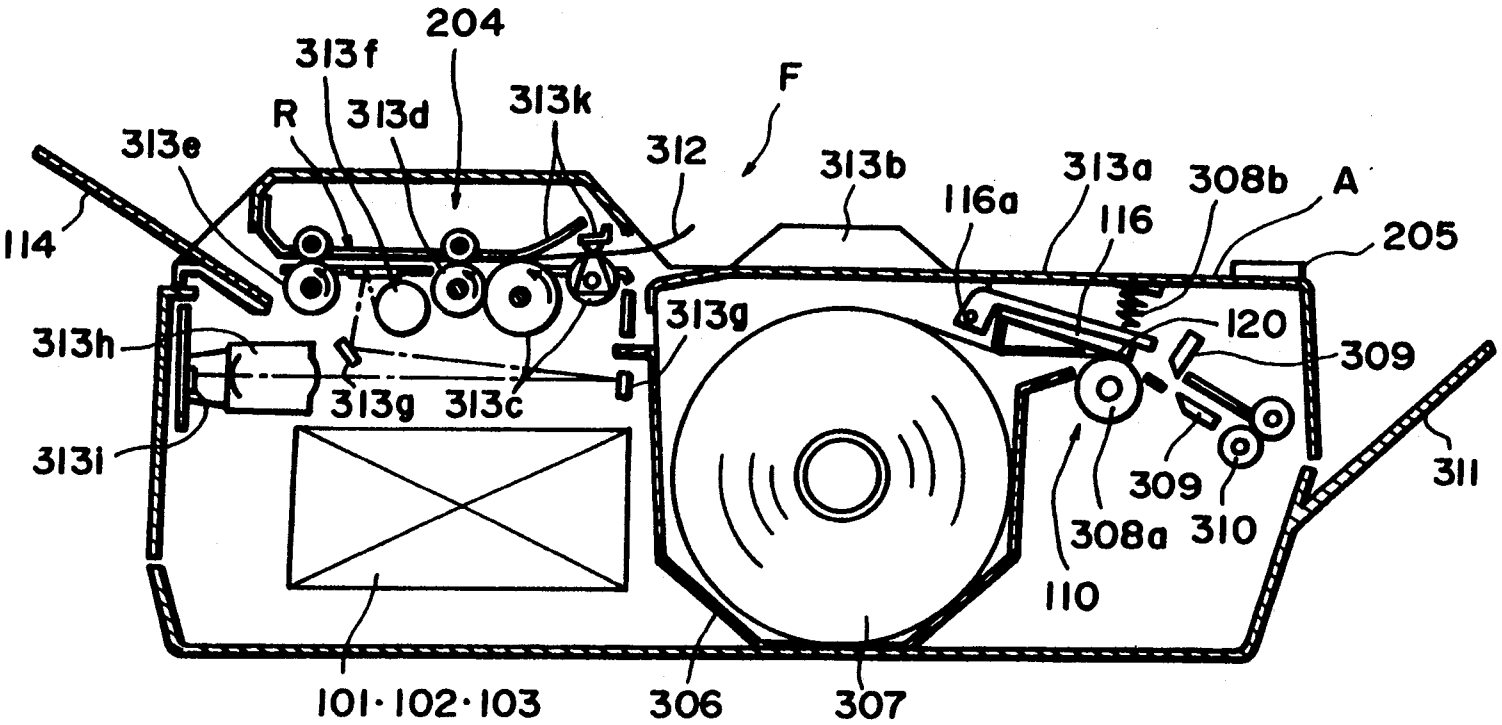
FIG. 8 is a side sectional view showing the facsimile machine.

FIG. 7 is a schematic block diagram showing an arrangement of a facsimile machine which employs the present invention. FIG. 8 is a side sectional view of the facsimile machine. The same reference numerals as in the above embodiments denote the same parts in FIG. 7, and the description made with reference to these embodiments applies to FIG. 7.

Referring to FIG. 7, the facsimile machine includes the main control unit 200 for controlling the overall operations of the facsimile machine. The main control unit 200 includes the CPU 202 (corresponding to the CPU 100 shown in FIG. 1) for executing various control operations in accordance with control programs and various data stored in a ROM 201 (corresponding to the ROM 101 shown in FIG. 1), and a RAM 203 (corresponding to the RAM 102 shown in FIG. 1) which is used as a work area of the CPU 202 to temporarily store various data. A reader unit 204 (to be described later in detail with reference to FIG. 8) receives and photoelectrically reads a transmitted original image. An operation unit 205 includes an operation panel (e.g., a keyboard) operated by an operator to input various operation instructions and a display unit (e.g., a liquid crystal display unit) for displaying messages to the operator.

An encoder unit: 206 encodes transmitted original image data by, e.g., an MH coding scheme. The encoder unit 206 encodes image data sent from the main control unit 200 and outputs encoded data to a transmitting and receiving unit 208. A decoder unit 207 decodes the received image data into image data and outputs the image data to the main control unit 200. During decoding of the received data, the decoder unit 207 outputs information representing the mode of the received data, e.g., a normal mode or a fine mode, to the main control unit 200. The transmitting and receiving unit 208 controls transmission/reception to/from a communication line 209 such as a public line. A conveying mechanism 115 includes a recording paper feed stepping motor and a recording paper conveying members (e.g., a platen roller 308*a* in FIG. 8).

With the above arrangement, when image data from another facsimile machine is to be received by the facsimile machine or an image signal from the reader unit 204 of its own is to be recorded, the main control unit 200 transfers one-line image data and a clock signal synchronized therewith to a thermal head 116 through a signal line 120. When the one-line data to be recorded is transferred to the thermal head 116, the main control unit 200 outputs a command for recording commencement to the control unit 111 of the recording unit 110.

Upon reception of the command for recording commencement from the main control unit 200, the control unit 111 determines recording energization time of the thermal head 116 on the basis of a temperature signal from a sensor 124 and a table (i.e. , a table which stores pulse widths respectively corresponding to temperatures) of the ROM 113 and drives the thermal head 116 within the determined energization time, thereby performing color development of a roll of thermal recording paper 308 (FIG. 8) and recording information thereon. The control circuit 111 then performs the preheat as described in each of the embodiments on the basis of the pre-heat data from the main control unit 200.

The facsimile machine which employs the present invention will be described with reference to FIG. 8. The facsimile machine is represented by F in FIG. 8. The facsimile machine F includes a roll holder 306. The recording paper 307 is fitted in the roll holder 306. Recording on the recording paper 307 fitted in the roll holder 306 is performed in the recording unit 110. After recording is terminated, the recording paper 307 is cut by a cutter 309 at a position of the trailing end of the image. The cut sheet is delivered outside the machine by a delivery roller pair 310 and is stored on a tray 311.

The platen roller (driven by the stepping motor included in the conveying mechanism 115) 308*a* for conveying the recording paper 307 stepwise and the linear thermal head 116 urged against the roller 308*a* by a spring 308*b* are arranged in the recording unit 110. Recording is performed on the thermal recording paper 307 in accordance with an image signal. The thermal head 116 is pivotal about a shaft 116*a*.

An original table 313*a* formed on the upper surface of a cover A is included in an original reading system 204. A plurality of originals 312 placed on the table 313*a* such that their image surfaces face downward are separated by a separation roller 313*c* one by one while both sides of each original is being guided by side guides 313*b*. Each original is conveyed by a conveying roller 313*d* stepwise to a reading position R. The original 312 whose image is read at the reading position R is delivered by a delivery roller 313*e* to a delivery tray 314. Separation pieces 313*k* urge against the separation roller 313*c*.

The original surface is irradiated with light from a light source 313*f* while the original 312 is being fed along the original reading position R. Light reflected by the original image surface reaches a CCD 313*i* through a plurality of mirrors 313*g* and a lens 313*h*. The CCD 313*i* in the facsimile machine reads the original image, and the image signal is transmitted to the recording system of its own or another facsimile machine, as described above.

The thermal head 116 control as described in each embodiment is performed in the facsimile machine F.

Figure 9:
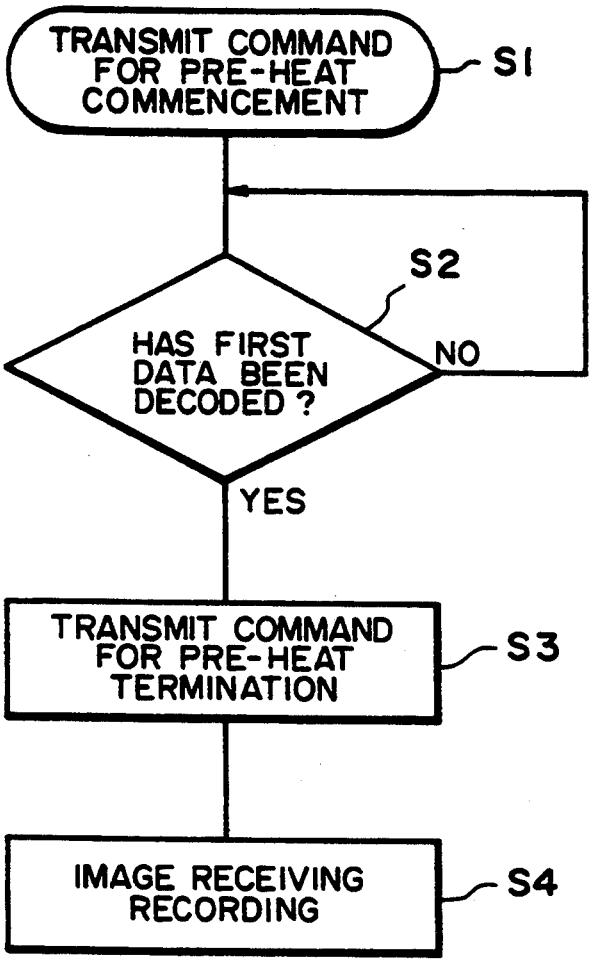
FIG. 9 is a flow chart for explaining an operation of the facsimile machine.

FIG. 9 is a flow chart wherein the control described with reference to each embodiment is applied to the facsimile machine F. Upon power-ON or reception of one-page information, a command for pre-heat commencement is output to start pre-heat in step 1. It is determined in step 2 whether the first data of the first line has been decoded. When the first data is completely decoded, a command for pre-heat termination is output in step 3. Therefore, a receiving time delay of the facsimile machine can be prevented although pre-heat is performed.

In each embodiment described above, thermal recording system is exemplified. However, the present invention is not limited to this, but is also applicable to, e.g., an ink-jet recording scheme, a thermal transfer recording scheme, and a electrothermosensitive recording scheme. The recording medium is not limited to thermal paper, but may be, e.g., normal paper and processed paper.

According to the present invention as has been described above in detail, there is provided a recording method and apparatus, which improves recording quality.

What is claimed is:

1. A recording apparatus for recording on a recording medium, said apparatus comprising:

a plurality of heat generating elements;

selecting means for dividing said plurality of heat generating elements into a plurality of blocks of a number N; and control means for providing said heat generating elements of each of said blocks with energy in accordance with an image information, for preheating said heat generating elements during a stand-by time from a termination of recording to a start of a next recording, wherein not more than 1/N numbers of said heat generating elements of each of said blocks are selected, and for providing said selected heat generating elements with energy in each of said blocks.

2. A thermal recording apparatus using a thermal line head divided into a plurality of blocks of a number N to perform recording in units of blocks, comprising:

a plurality of heat generating elements disposed in said thermal line head;

heating means for simultaneously and intermittently heating said plurality of heat generating elements of said thermal line head, said heating means providing energy having a level lower than an actual recording level to said plurality of heat generating elements of said thermal line head; and output means for outputting an updated data every heating and outputting the updated data to said thermal line head during heating by said heating means, wherein the updated data represent a number of said heat generating elements of said thermal line head to be energized, said number being not more than 1/N of a total number of said heat generating elements.

3. An apparatus according to claim 2, wherein said output means is arranged independently of a means for outputting recording data to said thermal head during recording.

4. A recording apparatus for recording on a recording medium by dividing a plurality of heat generating elements into a plurality of blocks, said blocks being of a number N, and providing energy to each of said blocks, said apparatus comprising:

said plurality of heat generating elements;

conveying means for conveying said recording medium;

a mounting section for mounting a recording head having a plurality of said heat generating elements, said recording head having a temperature; and control means for simultaneously providing energy to all said blocks to heat not more than 1/N numbers of all said head generating elements, and for controlling a preheat of said heat generating elements during a preheat cycle during a stand-by time, said stand-by time being a period from termination of a first recording to a start of a next recording, wherein said energy is of a lower level than a level of energy provided during said first recording to said heat generating elements.

5. A recording apparatus according to claim 4, wherein said heat generating elements are provided in line.

6. A recording apparatus according to claim 4, further comprising a temperature sensor for detecting said temperature of said head having said heat generating elements, and wherein said preheat is performed when the temperature detected by said sensor is less than a predetermined temperature.

7. A recording apparatus according to claim 6, wherein a temperature of said preheat is controlled in accordance with the temperature detected by said sensor.

8. A recording apparatus according to claim 4, wherein said preheat is performed for each of said blocks.

9. A recording apparatus according to claim 4, wherein said preheat is performed intermittently and plural times until said stand-by time is terminated.

10. A recording apparatus according to claim 4, wherein said preheat is performed according to preheat data, and wherein said preheat data represents said heat generating elements to be energized as bits in one byte which are shifted so that a same one of said heat generating elements is not energized continuously for each said preheat cycle.

11. A recording apparatus according to claims 1 or 4, wherein said heat generating elements are recording elements.

12. A recording apparatus according to claims 1 or 4, wherein when said control means provides said heat generating elements with less energy than is provided during recording, said heat generating elements are so provided in accordance with a pulse width of a strobe signal, a provided voltage, a provided current, or an output number of the strobe signal.

13. A recording apparatus according to claims 1 or 4, wherein said recording apparatus is a facsimile machine having reading means for reading an image, receiving means for receiving signals and transmitting means for transmitting signals.

14. A recording apparatus according to claims 1 or 4, wherein said recording apparatus utilizes a thermal recording method.

15. A recording apparatus according to claims 1 or 4, wherein said recording apparatus utilizes an ink jet recording method.

16. A recording apparatus according to claims 1 or 4 further comprising a temperature sensor for detecting a temperature of said heat generating elements and for preheating said heat generating elements to a preheat temperature when the temperature detected by said sensor is less than a predetermined temperature.

17. A recording apparatus according to claim 16, wherein said preheat temperature is controlled in accordance with the detected temperature.

18. A recording method for recording using a recording head having a plurality of heat generating elements, said method comprising the steps of:

dividing said heat generating elements into a plurality of blocks of a number N, each of said blocks having a plurality of said heat generating elements; and simultaneously selecting all of said blocks in a preheat cycle during a preheat period and preheat driving said heat generating elements with energy insufficient to record in accordance with preheat data, said preheat data being defined to drive not more than 1/N of all said heat generating elements.

19. A method according to claim 18, further comprising the step of sequentially selecting each of said blocks during recording and driving said heat generating elements of said selected blocks with energy sufficient to record in accordance with recording data.

20. A method according to claim 19, wherein said recording data and said preheat data are stored in a same storing means.

21. A method according to claim 18, wherein said preheat data comprises a bit pattern corresponding to each of said heat generating elements and the bit pattern defines which of said heat generating elements are to be driven.

22. A method according to claim 18, further comprising the step of converting said preheat data in each said preheat cycle so that different said heat generating elements are driven in consecutive said preheat cycles.

23. A method according to claim 22, wherein said preheat data comprises a bit pattern corresponding to each of said heat generating elements and the bit pattern defines which of said heat generating elements are to be driven.

24. A method according to claim 23, wherein said step of converting further comprises shifting said preheat data comprising said bit pattern by one bit in each preheat cycle.

25. A method according to claim 18, wherein said recording head is a thermal head for causing printing on a thermosensitive paper by utilizing a plurality of energies generated by said heat generating elements.

26. A method according to claim 18, wherein said recording head is an ink jet head for discharging an ink to a recording sheet in response to a plurality of energies generated by said heat generating elements.

* * * * *

UNITED STATES PATENT AND TRADEMARK OFFICE

CERTIFICATE OF CORRECTION

PATENT NO. : 5,381,164

DATED : January 10, 1995

INVENTOR : TAKESHI ONO

It is certified that error appears in the above-identified patent and that said Letters Patent is hereby corrected as shown below:

ON THE TITLE PAGE

At [54] The title should read

--METHOD AND APPARATUS FOR PREHEATING A THERMALLY ACTIVATED PRINTING HEAD--.

At [57] ABSTRACT

Line 6, "see" should read --same--.

COLUMN 1

Line 24, "installed" should read --operated--.
Line 66, ".its" should read --its--.

COLUMN 3

Line 23, "foyer" should read --four--.

COLUMN 4

Line 5, "One-line" should read --After one-line--.
Line 35, "step $2," should read --step S2,--.

COLUMN 7

Line 19, "step, S6" should read --step S6--.
Line 22, "con, hand" should read --command--.

UNITED STATES PATENT AND TRADEMARK OFFICE

CERTIFICATE OF CORRECTION

PATENT NO. : 5,381,164

DATED : January 10, 1995

INVENTOR : TAKESHI ONO

It is certified that error appears in the above-identified patent and that said Letters Patent is hereby corrected as shown below:

COLUMN 7 (cont'd.)

Line 45, "Reference" should read --Referring--.
Line 54, "steins." should read --steps.--.

COLUMN 8

Line 56, "unit: 206" should read --unit 206--.

COLUMN 9

Line 2, "members" should read --member--.
Line 52, "is" should read --are--.

COLUMN 10

Line 7, "step 1." should read --step S1.--.
Line 8, "step 2" should read --step S2--.
Line 11, "step 3." should read --step S3.--.
Line 18, "a" should read --an--.
Line 24, "apparatus," should read --apparatus--.
Line 38, "stand-by" should read --standby--.

COLUMN 11

Line 16, "stand-by" should read --standby--.
Line 39, "stand-by" should read --standby--.
Line 61, "signals" should read --signals,--.

UNITED STATES PATENT AND TRADEMARK OFFICE

CERTIFICATE OF CORRECTION

PATENT NO. : 5,381,164

DATED : January 10, 1995

INVENTOR : TAKESHI ONO

It is certified that error appears in the above-identified patent and that said Letters Patent is hereby corrected as shown below:

COLUMN 12

Line 7, "4" should read --4,--.

Signed and Sealed this

Twenty-second Day of August, 1995

Bruce Lehman

*Attest:*

BRUCE LEHMAN

*Attesting Officer*

*Commissioner of Patents and Trademarks*